United States Patent [19]

Eissele et al.

[11] Patent Number: 4,961,751

[45] Date of Patent: Oct. 9, 1990

[54] METHOD OF BLEACHING DYED COTTON GARMENTS

[75] Inventors: Ernest M. Eissele, Holland, Pa.; Edward S. Rogers, Princeton; Arno H. Reidies, LaSalle, both of Ill.

[73] Assignee: Carus Corporation, LaSalle, Ill.

[21] Appl. No.: 188,419

[22] Filed: Apr. 29, 1988

[51] Int. Cl.[5] ..... D06L 3/02

[52] U.S. Cl. ..... 8/111; 8/101; 8/107

[58] Field of Search ..... 8/108, 111, 137, 101, 8/102

[56] References Cited

U.S. PATENT DOCUMENTS

| | | | |
|---|---|---|---|
| 3,535,262 | 10/1970 | Hubbuch et al. | 252/186 |
| 4,218,220 | 8/1980 | Keppler et al. | 8/102 |
| 4,279,764 | 7/1981 | Brubaker | 252/99 |
| 4,460,490 | 7/1984 | Barford et al. | 252/99 |
| 4,655,782 | 7/1987 | McCallion et al. | 8/111 |
| 4,657,784 | 4/1987 | Olson | 427/213 |
| 4,711,748 | 12/1987 | Irwin et al. | 252/96 |
| 4,740,213 | 4/1988 | Ricci | 8/108.1 |
| 4,795,476 | 1/1989 | Bean et al. | 8/107 |
| 4,900,323 | 2/1990 | Dickson et al. | 8/111 |

FOREIGN PATENT DOCUMENTS

| | | |
|---|---|---|
| 2311964 | 9/1920 | Fed. Rep. of Germany . |
| 842224 | 7/1960 | United Kingdom . |
| 2118463 | 11/1983 | United Kingdom . |

*Primary Examiner*—Paul Lieberman
*Assistant Examiner*—John F. McNally
*Attorney, Agent, or Firm*—Tilton, Fallon, Lungmus & Chestnut

[57] ABSTRACT

A method is provided for selectively bleaching dyed, bleachable cotton garments. The garments are tumbled in damp condition with reuseable pre-formed solid pellets of limited porosity having abradable surfaces. The pellets comprise substantially water-insoluble cemented aggregates of mineral particles with a finely-divided particulate bleaching aent imbedded therein. The bleaching agent, which preferably is substantially uniformly distributed in the pellets, bleaches the garments by surfaces of the pellets wearing away during the garment tumbling to release the bleaching agent as the pellets contact the garments.

12 Claims, No Drawings

METHOD OF BLEACHING DYED COTTON GARMENTS

FIELD OF THE INVENTION

The field of this invention is the treatment of dyed bleachable cotton garments with abrading and/or bleaching agents to produce a "frosted" appearance.

BACKGROUND OF INVENTION

In the United States, and, in fact, throughout the world, there is a large demand for cotton denim garments which have a distinctly faded, partially worn appearance. These garments are referred to as "frosted", "iced", "whitewashed", or "acid-washed". Although cotton denim accounts for the bulk of the "frosted" fabrics, other cotton materials, such as different types of twills and cotton corduroys are also subject to frosting.

It has been known for many years to use abrasive materials, such as pumice, to "stone-wash" dyed cotton twills to create a preworn appearance. More recently, this "worn" or "distressed" look has become particularly fashionable in apparel made from denim or similar cotton fabric, which has usually been dyed a bluish to black color. Earlier processing consisted primarily of dry tumbling the cotton garments with a quantity of pumice stones in commercial washing machines so that part of the dye was mechanically removed from the fabric. However, a non-abrasive bleaching process for "bluejeans" has been proposed (U.S. Pat. No. 4,218,220). Currently, the "bluejean" industry's preference is for methods which include mechanical abrasion in combination with chemical bleaching.

In one industry practice, natural pumice stones, which are porous, are soaked in an aqueous solution of an oxidizing-type bleaching agent. Both sodium hypochlorite and potassium permanganate have been used. There is a preference for potassium permanganate since the hypochlorite tends to damage the fabric. Any staining from residual manganese dioxide can be removed with a neutralizing agent, such as sodium bisulfite. Permanganate is also advantageous in that it avoids the production of irritating fumes which can result from a chlorine-liberating bleaching agent.

In the use of natural pumice stones pre-soaked in an aqueous solution of a bleaching agent, several practical disadvantages have been encountered. Even though the stones are drained of excess solution, they can continue to release the bleaching solution by seepage during storage. Further, the initial contacting of the stones with the moist denim garments can result in overbleaching. As the treatment continues the degree of bleaching decreases. Such irregular bleaching can result in a streaked, unattractive appearance. Moreover, the bleach solution is substantially exhausted with each use of the stones, and they must be resoaked frequently.

Several improvements have been proposed. In one procedure which is being used commercially to some extent, the natural pumice stones are pre-impregnated under pressure/vacuum conditions, the details of which are not known. This preparation treatment may provide for greater degree of impregnation, and more use of the stones without recharging. However, these stones do continue to exude solution on standing, and the initial use of the stones can result in spotty bleaching which is generally undesirable.

Another alternative which has also received some degree of commercial use is to employ a loose mixture of a bleaching agent with an inert but somewhat abrasive filler, such as, for example, potassium permanganate powder and fine quartz sand or other siliceous material. The frosting effect obtained from such a free-flowing mixture is rather "flat" and is considered to be less attractive.

Potassium permanganate and other bleaching agents have been encapsulated or adsorbed on support materials or embedded in formed bodies for other purposes. See, for example, U.S. Pat. Nos. 3,535,262, 4,279,764, 4,460,490, 4,665,782, 4,657,784, and 4,711,748. German Patent No. 2,311,964 describes the preparation of a product for decontaminating radioactive waste containing manganese dioxide ($MnO_2$) in Plaster of Paris (gypsum). A slurry is formed from manganese sulfate ($MnSO_4$) and potassium permanganate ($KMnO_4$) and gypsum which is cast into blocks. The $MnSO_4$ and $KMnO_4$ react in the slurry to form the $MnO_2$, which is dispersed throughout the gypsum mass and removes radionuclides by adsorption.

SUMMARY OF INVENTION

This invention provides a greatly improved method of frosting dyed bleachable cotton garments. Instead of natural pumice stones, especially prepared artificial stones are employed. In accordance with the present invention, the artificial stones are composed of cemented aggregates of mineral particles which provide abradable surfaces. A bleaching agent is dispersed throughout the stones, being embedded in the cemented aggregate. Thus, this bleaching agent, which is preferably an alkali metal permanganate, occurs in the form of fine to microscopic particles rather than being present as an aqueous solution as in prior practice.

When the garments are tumbled in moist condition in contact with the artificial stones, exterior surfaces of the stones abrade, gradually releasing the bleaching agent. Light to moderate to high contrast bleaching can be produced without overbleaching and without fiber damage, and the stones can be reused repeatedly until they completely disintegrate.

The artificial stones can be shipped and stored after manufacture without concern about the leaking of bleach solution. They will retain their capacity to provide a gradual bleaching action. Initial overbleaching or subsequent underbleaching is avoided. Last, but not least, this product takes much of the drudgery out of the garment frosting operation and eliminates most of the hazards normally associated with the handling of bleaching agents in their concentrated forms.

DETAILED DESCRIPTION

The artificial stones of this invention are especially suitable for use with potassium permanganate ($KMnO_4$) and sodium permanganate ($NaMnO_4$) as the bleaching agents. However, they can be advantageously used with other bleaching agents, including potassium or other alkali metal manganates, such as $K_2MnO_4$. Chlorinebased bleaching agents can also be used, including sodium hypochlorite or other alkali metal hypochlorites. Other active chlorinereleasing bleaching agents which can be used include organic halogen bleaches, for example, chlorocyanurates. Of this class, sodium dichloroisocyanurate dihydrate is preferred. The bleaching agent is added to the cement formulation in either solid or liquid form, i.e., as an aqueous solution.

$KMnO_4$ and sodium dichloroisocyanurate are preferably added as particulate solids, whereas in the case of sodium permanganate and sodium hypochlorite, addition as a solution is preferred. With liquid addition, the use of a hydrable self-curing cement is preferred, as will subsequently be described. Even though the bleaching agent is added as an aqueous solution, the water-binding action of the cement can leave most of the bleaching agent as highly dispersed solid particles.

Even though some bleaching agents other than potassium or sodium permanganate, i.e., sodium hypochlorite and sodium dichlorocyanurate dihydrate, function as active ingredients in the artificial frosting stones, their performance is at a much lower level than those of permanganate-containing formulations. The preferred choices for high-intensity frosting are combinations of sodium or potassium permanganate in either gypsum or magnesia cements. Where low bleaching intensities are desired (such as in chemically enhanced stone washing), combinations of Na or K permanganate with Portland cement—preferably white cement—can be used.

The artificial stones of this invention are prepared with abradable surfaces. More specifically, they comprise cemented aggregates of mineral particles with a bleaching agent embedded therein, which is preferably in particulate form. The bleaching agent may be mixed dry or as an aqueous solution with the aggregate material, and may be self-curing in cemented form, or there may be included a binder in addition to the aggregate material. An appropriate amount of water is added to the mix. The stones can be formed from low moisture mixes, which may be a paste or thick slurry, which can be formed into the stones by forming processes, such as extrusion, molding, agglomeration, etc.

A preferred major component of the stones' matrix material is a self-curing inorganic cement. Gypsum (plaster of paris) is particularly desirable. Hydratable gypsum may be used in a similar form as for preparing gypsum wallboard. When mixed with a small amount of water the gypsum will hydrate and set to an integrated solid body. By premixing the hydratable gypsum powder with the particulate bleaching agent, adding a small amount of water to form a thick paste, the artificial stones can be formed with the agent particles dispersed therethrough essentially in encapsulated or embedded form. Even though the porosity or the artificial stones is limited, the bleaching agent can e progressively released by surface abrasion.

Depending on the method of aggregation chosen, various commercial forms of gypsum may be used. Unformulated gypsum, in the hemihydrate form, is a rapid setting material, allowing only a very limited time for forming into pellets. Specifically when using extrusion as the aggregation method, the hydration of gypsum is accelerated by the addition of permanganate. The setting rate can be controlled by addition of one or more decelerants, to allow time to mix and form the material into pellets prior to setting. Commercially available slow-set gypsums are usually retarded by addition of an organic component, e.g., citric acid or hydrolyzed protein, which are attacked by the oxidizing agent. The retardants used for this process should be inorganics such as $H_3PO_4$, $NaH_2PO_4$, $Ca(H_2, PO_4)_2$, $Na_2B_4O_7$, etc. Elevated temperature and pressure are also accelerants of gypsum setting, so a very dry mixture, which will generate heat and pressure when being worked, should be avoided.

Other self-curing cements include the family of magnesia cements, viz., magnesium oxychloride and magnesium oxysulfate. These cements are also referred to as "Sorel" cements. Further usable cements also include Portland cement (white Portland cement is especially desirable because of its low iron content), Pozzolan cement, calcium aluminate cement, and related cements.

An advantage of forming the stones from a self-curing or hydratable cement is that the cement component provides sufficient abrasive action so that the fabric is subjected simultaneously to both bleaching and abrasion. When a binder is used which is not itself abrasive, mineral filler can be used in combination with the binder. The stones may be composed of an abrasive mineral filler united by an inorganic binder, and the particulate or liquid bleaching agent may be distributed therethrough in the same manner as described for the self-curing cement type of stones. A preferred inorganic binder is sodium silicate (water glass) or potassium silicate. Alternatively, sodium or other alkali metal or water-soluble aluminate binders can be used. The abrasive mineral fillers may be selected from a wide variety of materials including clays, diatomaceous earth, ground pumice, precipitated silica, fine quartz sand, finely-divided perlite, natural or synthetic zeolites, etc.

Representative formulations of the artificial stones are set out below.

| Ingredients | Wt. % Range | Preferred Wt. % |
|---|---|---|
| General Formulas for Artificial Stones Formed From Self-Curing Cements | | |
| Cement | 70–99.5 | 85–90 |
| Bleaching agent | 0.5–30 | 10–15 |
| Formulas for Artificial Stones Produced from Mineral Fillers and Inorganic Binders | | |
| Bleaching agent | 5–25 | 10–15 |
| Mineral binder | 3–20 | 5–10 |
| Mineral filler | 55–92 | 75–85 |
| Water | | |

For effective use as frosting agents, the bleach-containing solidified cements are formed into suitable lump or pellet form, comprising the artificial stones. The stone size and form can influence the bleaching pattern obtainable in the frosting step. Given comparable tumbling times, the regularity and uniformity of the bleach effect increases with decreasing stone size. Conversely, the larger the stone, the more spotty and irregular the bleached areas become. Preparation of stones of various sizes can be achieved in a number of ways. For example, the bleach-containing cement paste can be poured into molds of a variety of shapes and sizes. For example, large slabs of 0.5 to 1.5 inches thickness can be formed, and then cut into rectangular or square pieces of 1" to 1.5" side length, or any other desirable dimension. Alternately, the slabs can be mechanically crushed to give irregular shaped lumps, with desirable size ranges to be separated out by a classifier. As another procedure, the cement paste can be poured directly into individual molds of the desired shape and size. For agglomeration by molding, the water content of the paste should be slightly higher (to make it pourable) than for the aggregation methods described below. Stones suitable for frosting or garments can also be made by extrusion, disk pelletization, briquetting, tabletting, or other methods familiar to those skilled in the art.

For example, 60 to 95 parts of a slow setting gypsum material (preferred 80 to 90 parts) are mixed with 5 to 15 parts of $KMnO_4$ and 0 to 25 parts of a thickener (preferred 0 to 10 parts), and water sufficient to form a stiff dough. This dough can then be formed into pellets by any method familiar to those skilled in the art; for example, by extrusion, or by rolling between textured rolls, or by pelletization, etc. Once formed, the pellets are self-drying and self-hardening due to the rehydration and setting of the gypsum. The amount of $KMnO_4$ used is an added control of bleaching intensity, along with tumbling time, and weight ratio of garments to pellets selected during the "frosting" step of this process.

This invention is further illustrated by the following examples.

EXAMPLE I

A measured quantity of crystalline or powdered potassium permanganate is dry mixed with a predetermined amount of filler. After a homogeneous blend is obtained, a predetermined quantity of binder plus the proper amount of water is worked in the mixture so that an extrudable mass is obtained. This, in most cases, represents a still powdery but slightly cohesive material. The mass is then extruded to form ¼" to ½" diameter rounds of about ¾" to 1½" in length. The sizes and shapes of the product are selected for convenience and maximum production rate. Diameters of 1/16" or even less or of 1" or more are possible. Instead of rounds, other geometrical shapes such as triangular, rectangular, or stars can be used. After extrusion, the product is cured at either ambient or elevated temperature (60°–110° C.). Curing at higher temperatures produces products of higher hardness and with slower release characterization.

The extruded product, containing about 10% $KMnO_4$ (or about 12% $K_2MnO_4$) is tumbled with damp denim garments for a period of 5 to 25 minutes. The weight ratio between the quantity of frosting agent and dry garment weight may range from 3 to 0.1, depending on the degree of bleaching desired. In the course of the tumbling operation the extruded pellets are abraded, being finally reduced to a powder. In this manner, the garments make a large number of contacts with the permanganate-containing extrudates of various sizes, whereby each contact produces localized bleaching action.

After completion of the frosting step, the garments are treated with a reducing agent—commonly sodium metabisulfite—to remove the brown stains of manganese dioxide.

EXAMPLE II 89 lb gypsum was mixed with 1 lb $Ca(H_2PO_4)_2$ (to retard hydration) and 10 lb $KMnO_4$ crystals, forming a uniform dry blend. Water was added to this blend in a high shear mixer to form a wet dough, which was then extruded through a die plate having ½" square holes. The soft pellets formed were fed onto a moving belt to set.

About 20 lb of water was used in forming this dough. As the gypsum hydrates, it uses about 15 lb of the water present ($CaSO_4.\frac{1}{2}H_2O + 1.5\ H_2O \rightarrow CaSO_4.2\ H_2O$). The heat of hydration causing vaporization of part of the remaining water. Some free water apparently remained in a highly dispersed form. A hard, dry plaster pellet containing $KMnO_4$ crystals was obtained.

EXAMPLE III 89 lb gypsum was mixed with 1 lb $Na_2B_4O_7$ retardant and 10 lb $KMnO_4$ crystals to a uniform dry blend, which was then mixed with water to form a wet dough. The dough was extruded through ½" square holes, forming soft pellets on a moving belt. These pellets were sprayed with a 10% $K_2SO_4$ solution to accelerate the gypsum set. The reaction of the gypsum hemihydrate to dihydrate absorbed most of the water from the system, and the heat of hydration drives off most of the rest. Hard, dry pellets were formed.

EXAMPLE IV 80 lb of slow setting gypsum was mixed with 10 lb of a clay extrusion aid and 10 lb of $KMnO_4$ crystals in a dry blending operation. A dough was formed from this blend by addition of about 20 lb of $H_2O$. The presence of clay thickened the dough so that firm, tough pellets were formed on extrusion through a die plate having ½" diameter round holes. These pellets were self-dried and hardened as in Examples II and III.

EXAMPLE V 260 g of slow setting gypsum was intimately mixed with 72 ml of a commercial 40% solution of sodium permanganate and 30 ml of water. The resulting deep purple paste was transferred into plastic molds of about 3.5 ml volume each. The mass began to stiffen after about 20 minutes and was set after 45 minutes, at which point the gypsum castings were removed from their molds. The black cherry colored pieces contained 10.3% sodium permanganate in a highly dispersed form.

A frosting test with this product (50 g frosting agent with 60 g blue denim tumbled for 30 minutes) showed high intensity, high contrast bleaching.

EXAMPLES VI to XI

Additional stone formulations and test results are summarized in Table A.

TABLE A

| Example No. | Quantity & Kind of Cement Used | Quantity & Kind of Bleaching Agent Used | Water Used | Thickening Time | Set Time | Hardness | Results of Frosting Test |
|---|---|---|---|---|---|---|---|
| VI | Magnesia cement 50 g MgO + 120 ml saturated $MgCl_2$ solution | 25 g $KMnO_4$ (solid) | — | 1 hr | 2.5 hr | hard | low intensity bleaching |
| VII | Magnesia cement 50 g MgO + 66 g $MgCl_2.6\ H_2O$ | 45 mL = 63 g 40% $NaMnO_4$ | 58 mL | 1 hr | 2.5 hr | hard | high intensity bleaching |
| VIII | 260 g Portland Cement (white) | 28.9 g $KMnO_4$ (as solid) | 84 mL | 1.5 hr | 6 hr | very hard | very low intensity bleaching |
| IX | 260 g Portland Cement (white) | 52 mL = 72.8 g 40% $NaMnO_4$ | 50 mL | 10 min | 1.5 hr | very hard | moderate intensity bleaching |

TABLE A-continued

| Example No. | Quantity & Kind of Cement Used | Quantity & Kind of Bleaching Agent Used | Water Used | Thickening Time | Set Time | Hardness | Results of Frosting Test |
|---|---|---|---|---|---|---|---|
| X | 260 g Portland Cement (white) | 107.7 g NaOCl solution (17% active chlorine) | none | 25 min | 1 hr | very hard | low intensity bleaching |
| XI | 260 g Portland Cement (white) | 28.9 g sodium dicyanurate dihydrate | 125 mL | 40 min | 1.5 hr | rough, crumbly surface | low intensity bleaching |

We claim:

1. The method of bleaching dyed, oxidizing agent-bleachable cotton garments, comprising tumbling said garments in damp condition with reuseable preformed solid pellets of limited porosity comprising a substantially water-insoluble abradable aggregate material formed from a self-curing mineral cement or from a mineral filler and a binder therefor, said pellets containing a finely-divided particulate oxidizing bleaching agent embedded in and surrounded by said aggregate material, the surfaces of said pellets wearing away to gradually release the bleaching agent as the pellets are tumbled with the garments.

2. The method of claim 1 in which said bleaching agent is a permanganate salt selected from the group consisting of potassium permanganate and sodium permanganate.

3. The method of claims 1 or 2 in which said aggregate material comprises a self curing mineral cement selected from the group consisting of gypsum, magnesia, Portland, Pozzolan, and calcium aluminate cements.

4. The method of claims 1 or 2 in which said aggregate material comprises a mineral filler and a binder therefor, said mineral filler being selected from the group consisting of clay, diatomaceous earth, ground pumice, precipitated silica, natural or synthetic zeolites, quartz sand, ground perlite, and mixtures thereof, and said binder being silicate binder selected from the group consisting of sodium silicate and potassium silicate.

5. The method of claims 1 and 2 in which said cotton garments are selected from the group consisting of blue or black-dyed jeans, skirts, shirts, and jackets formed from twill, denim, or corduroy fabrics.

6. The method of claim 1 in which said particulate bleaching agent is a water-soluble permanganate salt, and the pellets contain from 0.5 to 30 weight percent of said salt in substantially uniform distribution in said pellets.

7. The method of claim 1 in which said pellets comprise essentially hydrated gypsum and a water-soluble permanganate salt, and the pellets contain from 0.5 to 30 weight percent of said permanganate salt.

8. The method of bleaching dyed, oxidizing agent-bleachable cotton garments, comprising tumbling said garments in damp condition with reusable preformed solid pellets of limited porosity comprising a substantially water-insoluble abradable aggregate material formed from a self-curing hydratable mineral cement, and a finely-divided particulate water-soluble permanganate salt embedded in and surrounded by said aggregate material, the surfaces of said pellets wearing away to gradually release the permanganate salt as the pellets are tumbled with the garments.

9. The method of claim 8 in which said aggregate material is hydrated gypsum and said particulate permanganate salt is potassium permanganate in substantially uniform distribution in said pellets.

10. The method of claims 8 or 9 in which said permanganate salt is present in said pellets in an amount of from about 10 to 15% by weight.

11. The method of claim s 8 or 9 in which said garments are selected from the group consisting of blue or black-dyed jeans, skirts, shirts, and jackets formed from twill, denim, or corduroy fabrics.

12. The method of selectively bleaching dyed bleachable cotton garments, comprising tumbling the garments in damp condition with reuseable preformed solid pellets of limited porosity having abradable surfaces, said pellets comprising a substantially water-insoluble cemented aggregate of mineral particles and a finely-divided particulate bleaching agent embedded in and surrounded by said cemented aggregate, said particulate bleaching agent being substantially uniformly distributed in said pellets for bleaching said garments by the surfaces of said pellets wearing away during said tumbling to gradually release the bleaching agent as the pellets repeatedly contact the garments.

* * * * *

UNITED STATES PATENT AND TRADEMARK OFFICE

CERTIFICATE OF CORRECTION

PATENT NO. : 4,961,751

DATED : October 9, 1990

INVENTOR(S) : Eissele et al.

It is certified that error appears in the above-identified patent and that said Letters Patent is hereby corrected as shown below:

Column 2, lines 60 and 61, change "Chlorinebased" to --Chlorine-based--.

Column 2, line 63, change "chlorinereleasing" to --chlorine-releasing--.

Column 3, line 48, after "can" delete "e" and insert --be--.

UNITED STATES PATENT AND TRADEMARK OFFICE

CERTIFICATE OF CORRECTION

PATENT NO. : 4,961,752

DATED : October 9, 1990

INVENTOR(S) : Eissele et al.

It is certified that error appears in the above-identified patent and that said Letters Patent is hereby corrected as shown below:

Column 4, lines 30 through 41, delete the following table:

"

| Ingredients | Wt. % Range | Preferred Wt. % |
|---|---|---|
| General Formulas for Artificial Stones Formed From Self-Curing Cements | | |
| Cement | 70–99.5 | 85–90 |
| Bleaching agent | 0.5–30 | 10–15 |
| Formulas for Artificial Stones Produced from Mineral Fillers and Inorganic Binders | | |
| Bleaching agent | 5–25 | 10–15 |
| Mineral binder | 3–20 | 5–10 |
| Mineral filler | 55–92 | 75–85 |
| Water | | |

"

and insert the following table:

--

General Formulas for Artificial Stones Formed From Self-Curing Cements

| Ingredients | Wt. % Range | Preferred Wt. % |
|---|---|---|
| Cement | 70 - 99.5 | 85 - 90 |
| Bleaching agent | 0.5 - 30 | 10 - 15 |

Formulas for Artificial Stones Produced from Mineral Fillers and Inorganic Binders

| Ingredients | Wt. % Range | Preferred Wt. % |
|---|---|---|
| Bleaching agent | 5 - 25 | 10 - 15 |
| Mineral binder | 3 - 20 | 5 - 10 |
| Mineral filler | 55 - 92 | 75 - 85 |
| Water | | |

--

UNITED STATES PATENT AND TRADEMARK OFFICE

CERTIFICATE OF CORRECTION

PATENT NO. : 4,961,751

DATED : October 9, 1990

INVENTOR(S) : Eissele et al.

It is certified that error appears in the above-identified patent and that said Letters Patent is hereby corrected as shown below:

Column 6, line 8, delete "($CaSO_4 \cdot \frac{1}{2} H_2O + 1.5 H_2O \rightarrow CaSO_4 \cdot 2 H_2O$)" and insert --($CaSO_4 \cdot \frac{1}{2} H_2O + 1.5 H_2O \rightarrow CaSO_4 \cdot 2 H_2O$)--.

Column 6, line 15, after "$Na_2B_4O_7$" insert a space.

Columns 5 and 6, second column, third line under Example VII in Table A, change "$MgCl_2 \cdot 6 H_2O$" to --$MgCl_2 \cdot 6 H_2O$--.

Signed and Sealed this

Twenty-second Day of September, 1992

*Attest:*

DOUGLAS B. COMER

*Attesting Officer*

*Acting Commissioner of Patents and Trademarks*